US007128463B2

(12) United States Patent
Hong

(10) Patent No.: US 7,128,463 B2
(45) Date of Patent: Oct. 31, 2006

(54) PORTABLE MIXER

(76) Inventor: Thomas K. Hong, 1666 Queen Street East, Unit 18, Toronto, ON (CA) M4L 1G3

( * ) Notice: Subject to any disclaimer, the term of this patent is extended or adjusted under 35 U.S.C. 154(b) by 186 days.

(21) Appl. No.: 10/882,978

(22) Filed: Jul. 2, 2004

(65) Prior Publication Data

US 2005/0018531 A1 Jan. 27, 2005

Related U.S. Application Data

(60) Provisional application No. 60/489,892, filed on Jul. 25, 2003.

(51) Int. Cl.
*B28C 5/02* (2006.01)

(52) U.S. Cl. ..... 366/53; 366/210; 366/237; 366/239

(58) Field of Classification Search ..... 366/53, 366/209–211, 237, 239, 275
See application file for complete search history.

(56) References Cited

U.S. PATENT DOCUMENTS

| | | | | |
|---|---|---|---|---|
| 459,653 | A * | 9/1891 | Sampson | 366/210 |
| 643,094 | A * | 2/1900 | Hensel | 4/541.1 |
| 1,948,226 | A * | 2/1934 | Price | 366/45 |
| 2,499,162 | A * | 2/1950 | Rand | 68/96 |
| 2,793,788 | A * | 5/1957 | Lysne | 220/631 |
| 3,860,219 | A * | 1/1975 | Nickerson | 366/3 |
| 6,190,913 | B1 * | 2/2001 | Singh | 435/394 |

* cited by examiner

*Primary Examiner*—David Sorkin

(57) ABSTRACT

A portable mixer comprising a frame assembly. Wheels are operatively mounted on the frame assembly. A deck assembly is pivotally mounted on the frame assembly for tilting forwardly and rearwardly. A mixing bag is suspended from the frame assembly.

5 Claims, 6 Drawing Sheets

PORTABLE MIXER

This application claims the benefit of provisional application No. 60/489,892, filed 25 Jul. 2003.

FIELD OF THE INVENTION

The present invention relates to portable mixers, and more particularly to portable mixers that can be used to mix concrete and also to mix compost.

BACKGROUND OF THE INVENTION

The most commonly used method to mix concrete is to pour dry concrete mixture into a wheelbarrow or the like, and add small amounts of water until the desired consistency is reached.

It is well known that this method has a number of drawbacks. Firstly, it is necessary to lift the bag of concrete mixture of above the height of the wheelbarrow in order to dump the concrete mixture into the wheelbarrow. Further, the wheelbarrow becomes covered in moist, yet drying, concrete and is very difficult to clean. The method also requires a shovel to mix the water into the concrete mixture. Further, the actual mixing with a shovel is physically demanding and also causes the shovel to become covered in moist, yet drying, concrete.

One such device assists with the mixing of concrete, and the like, in a wheelbarrow. U.S. Pat. No. 6,749,328 issued Jun. 15, 2004 to Killen, discloses a Wheelbarrow with Mixing Assembly, wherein a wheelbarrow has a base assembly and an open hopper mounted on the base assembly. A motor turns a mixing blade positioned within the hopper. A shaft extends from the motor to the mixing blade. This apparatus is not suitable for mixing anything other than concrete and the like.

It is also well known to keep compostable materials in composters. Such composters typically comprise plastic containers with airflow vents. In order to assist the composting process, it is necessary to frequently mix the compost in such compost containers, perhaps as often as every couple of days in order to maximize the decomposition of the material in the compost.

Such mixing of compost is time-consuming and also is difficult if the composter is relatively full. Further, it is necessary to re-distribute the compost at the bottom of the composter, which is often quite difficult.

One such apparatus that tries to make the mixing of compost easier is found in U.S. Pat. No. 5,312,754 issued May 17, 1994 to Bryan-Brown and entitled Composting Apparatus and System. A second embodiment of this invention comprises a high strength fabric suspended on a tubular steel frame. The top layer of the fabric is perforated to allow the control passage of pressurized air therethrough, and forms an upper half of an inflatable cylinder. The outer layer of the fabric is impervious and forms a lower half of the inflatable cylinder. Pressurized air is forced in the inflatable cylinder, between the top and bottom layers, so as to inflate the high strength fabric cylinder. Upon inflation, the top layer raises compost piled thereon, thereby mixing the compost. Further, air passes through the perforated upper layer of fabric to aerate the compost. When the cylinder is deflated, further mixing of the compost takes place. The compost is retained in place by sloping walls that are each attached to the frame by a hinge. The sloping walls are folded down to remove the compost.

This unit has a significant disadvantage in that it requires a source of pressurized air in order to operate. Further, this apparatus cannot be used for mixing concrete and the like.

It is an object of the present invention to provide a portable mixer that mixes concrete.

It is an object of the present invention to provide a portable mixer that mixes concrete, wherein it is not necessary to lift the bag of concrete mixture two or three feet in order to dump the concrete mixture into the mixer.

It is an object of the present invention to provide a portable mixer that mixes concrete, wherein the mixer is easy to clean.

It is an object of the present invention to provide a portable mixer that mixes concrete, wherein a shovel is not required to mix the water into the concrete mixture.

It is an object of the present invention to provide a portable mixer that mixes concrete, wherein the mixing of the concrete is not physically demanding.

It is an object of the present invention to provide a portable mixer that mixes compost.

It is an object of the present invention to provide a portable mixer that mixes compost, wherein the proper mixing of the compost is not overly time consuming.

It is an object of the present invention to provide a portable mixer that mixes compost, wherein the proper mixing of the compost is not difficult even if the composter is relatively full.

It is an object of the present invention to provide a portable mixer that mixes compost, wherein all of the compost in the container is mixed fully and properly.

SUMMARY OF THE INVENTION

In accordance with one aspect of the present invention there is disclosed a novel portable mixer comprising a frame assembly, wheel means operatively mounted on the frame assembly, a deck assembly pivotally mounted on the frame assembly for tilting forwardly and rearwardly, and a mixing bag suspended from the frame assembly.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described herein below.

BRIEF DESCRIPTION OF THE DRAWINGS

The novel features which are believed to be characteristic of the portable mixer according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

Figure 1:
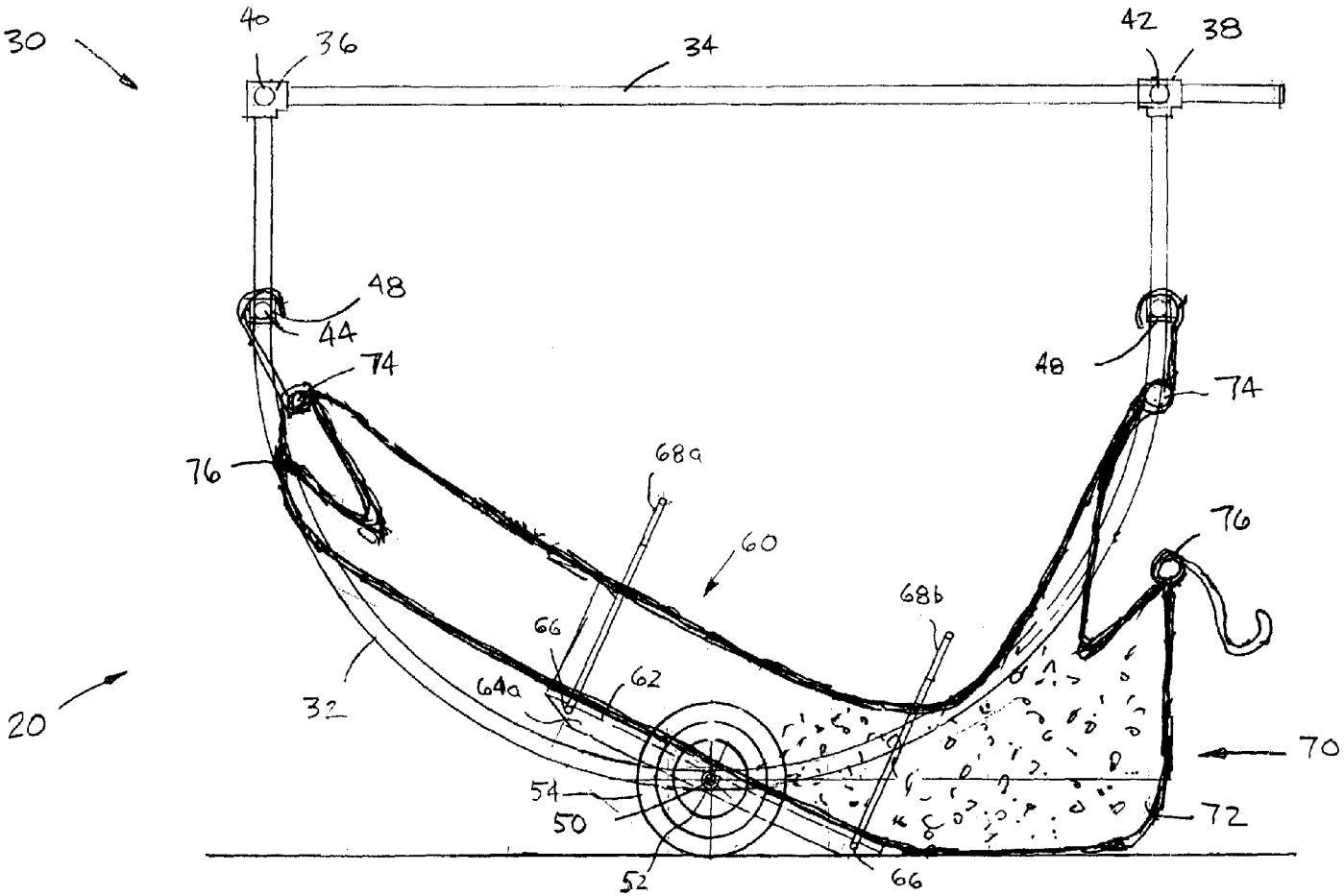
FIG. 1 is a side elevational view of the first preferred embodiment of the portable mixer according to the present invention.
Figure 2:
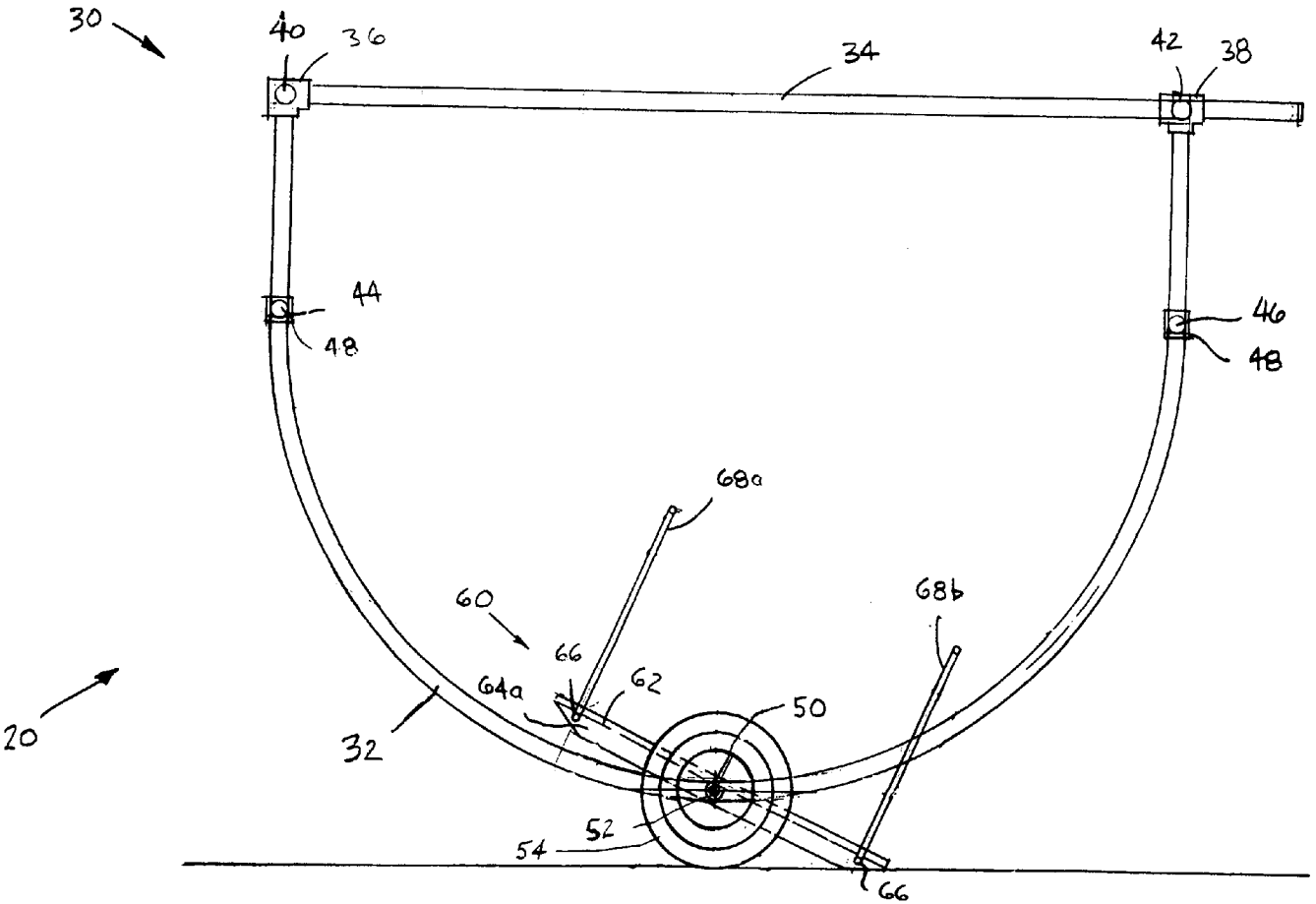
FIG. 2 is a side elevational view similar to FIG. 1, but with the mixing bag removed, and therefore showing only the frame assembly.
Figure 3:
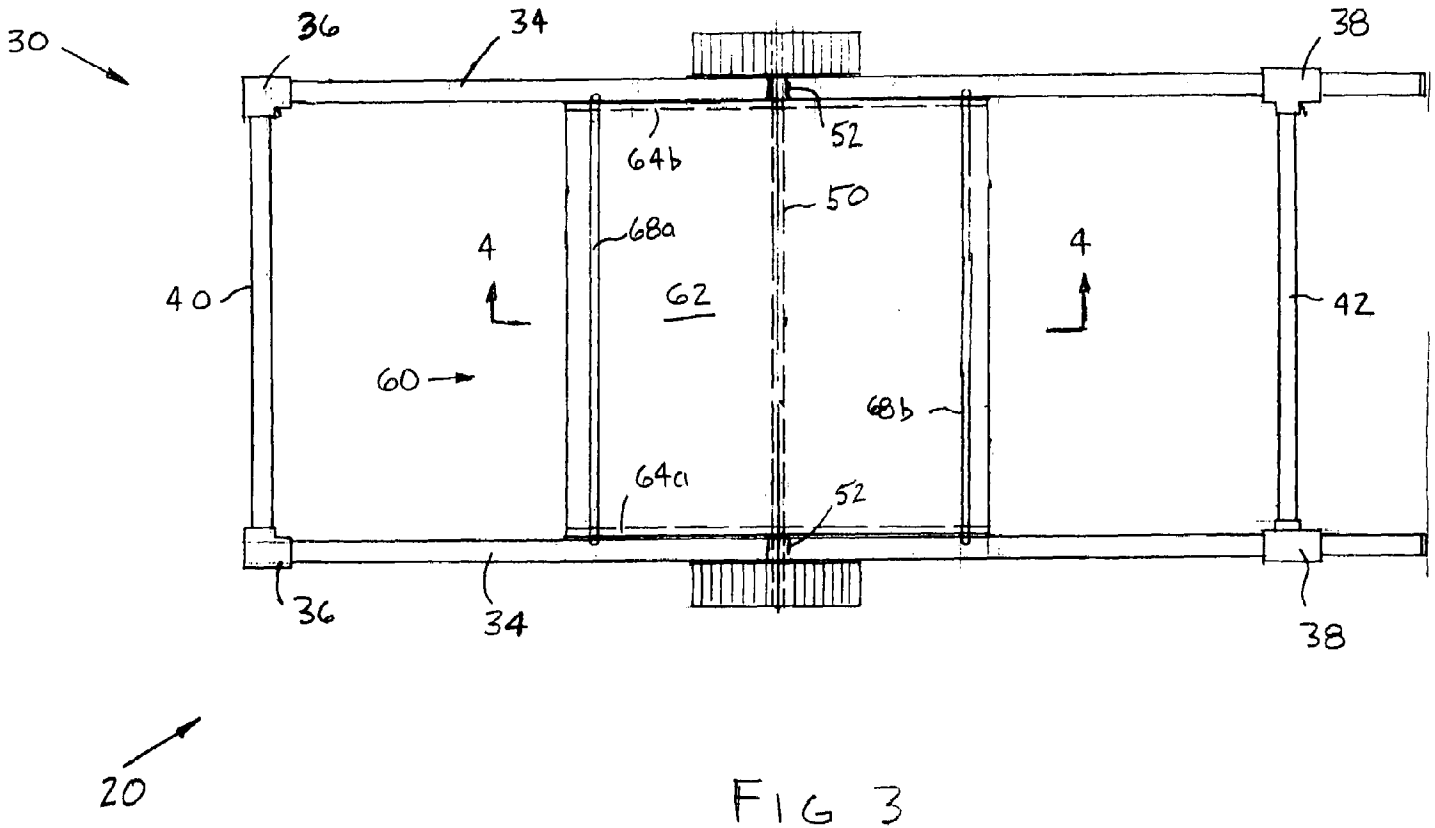
FIG. 3 is a top plan view of the frame assembly of FIG. 2.

Advantages, features and characteristics of the present invention, as well as functions of the related elements of the structure, and the combination of parts and economies of manufacture, will become more apparent upon consideration of the following detailed description with reference to the accompanying drawings.

DETAILED DESCRIPTION OF A PREFERRED EMBODIMENT

Reference will now be made to FIGS. 1 through 11, which show a first preferred embodiment of the portable mixer according to the present invention.

The portable mixer 20 comprises a frame assembly 30, a deck assembly 60 pivotally mounted on the frame assembly 30, and a mixing bag 70 suspended from the frame assembly 30.

The frame assembly 30 has a left half and a right half that are substantially mirror images of each other. Each of the left half and right half comprises a "U"-shaped main frame member 32 made from a galvanized iron pipe having an outside diameter of about one inch or so. A straight longitudinal frame member 34 also made from a galvanized iron pipe spans across the top of each "U"-shaped main frame member 32 and is retained in place by means of a three-way ninety degree elbow 36 disposed at the forward junction of the "U"-shaped main frame member 32 and the longitudinal frame member 34, and by means of a side outlet tee 38 disposed at the rearward junction of the "U"-shaped main frame member 32 and the longitudinal frame member 34. The longitudinal frame member 34 extends six inches beyond the back end of the "U"-shaped main frame member 32 to thereby form a handle 39 on each of the left and right sides of the portable mixer 20, extending outwardl from the fame assembly 30, for permitting manual manipulation of the portable mixer 20.

The left and right halves of the frame assembly 30 are connected together by four cross-members, specifically, two upper cross-members 40,42 and two lower cross-members 44,46. Each of the cross-members 40,42,44,46 is made from a galvanized iron pipe having outside diameter of about three-quarters of an inch. The two upper cross-members 40,42 are disposed at the top of the "U"-shaped main frame member 32 and are engaged into the three-way ninety degree elbows 36 and the side outlet tees 38, as appropriate. The two lower cross-members 44,46 are disposed about one foot down from the top end of the "U"-shaped main frame member 32, at each end of the frame member 32, and are engaged into co-operating short tees 48.

A wheel means is operatively mounted on the frame assembly 30 and comprises a wheel axle 50 made from half-inch diameter steel rod extends through co-operating apertures 52 in the bottom area of the "U"-shaped frame assembly 30. Mold-on rubber wheels 54 are mounted onto the ends of the wheel axle 50. The frame assembly 30 is tiltable fore and aft about the wheel axle 50, as will be discussed in greater detail subsequently. The wheels 54 make the portable mixer 20 readily mobile such that it can be readily wheeled about. The portable mixer 20 remains in place during use due to the deck assembly 60 tilting forwardly or rearwardly so as to engage the ground.

Figure 4:
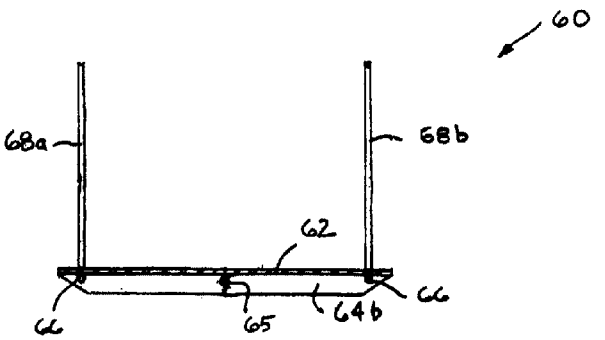
FIG. 4 is a cross-sectional side elevational view taken along section line 4—4 of FIG. 3, and shows the deck assembly.
Figure 5:
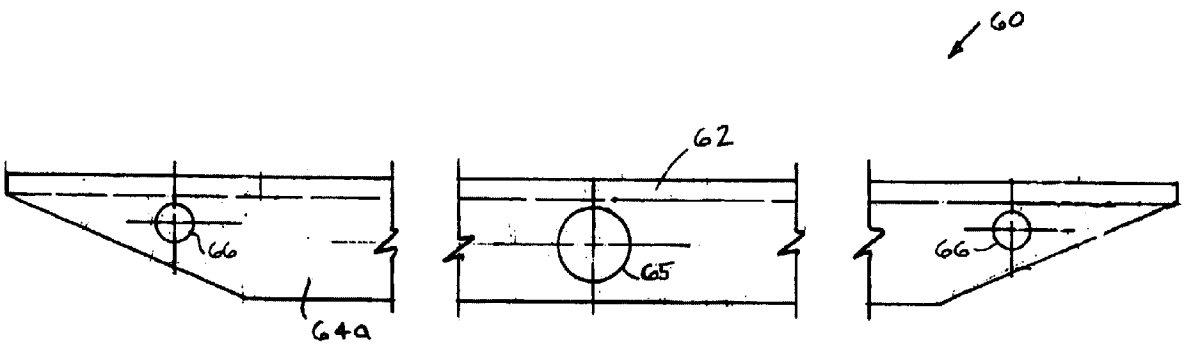
FIG. 5 is an enlarged side elevational view of portion of the frame assembly of FIG. 2.
Figure 6:
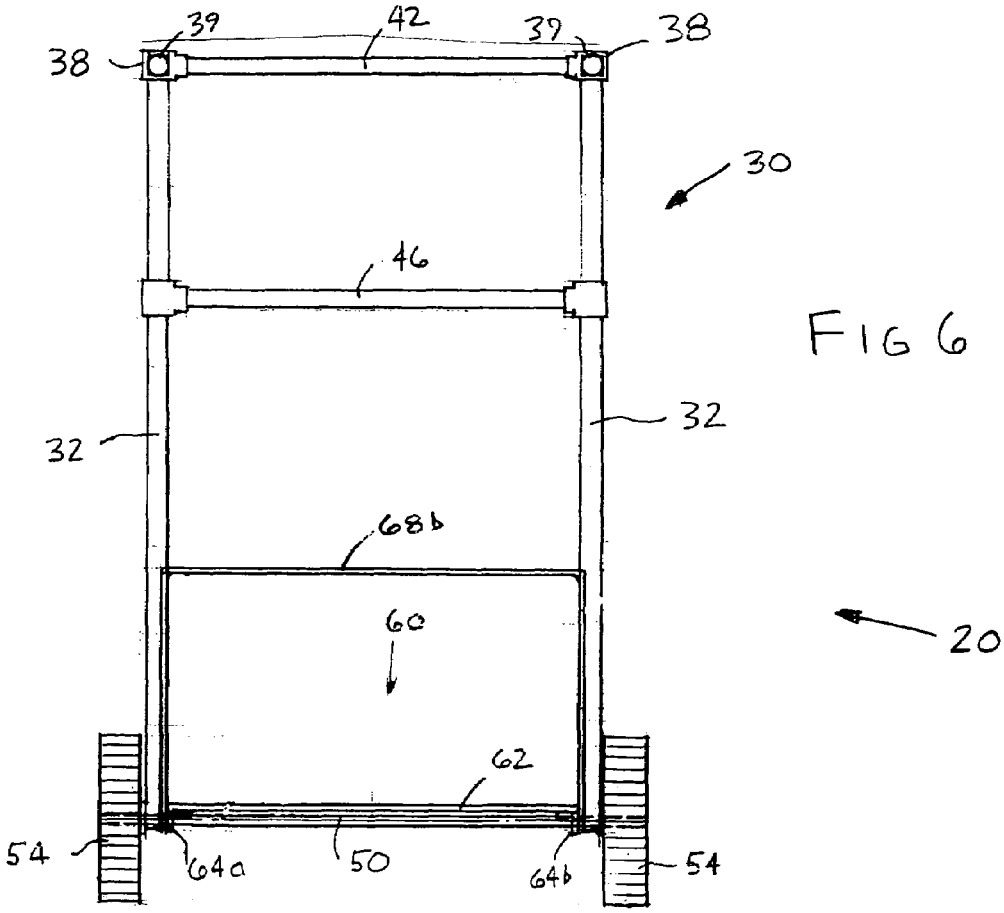
FIG. 6 is an end elevational view of the frame assembly of FIG. 2.

As can be best seen in FIG. 4, the deck assembly 60 comprises a substantially flat deck member 62 made from a one-eighth inch thick steel plate that is about twenty inches long and about nineteen and three-quarters inches wide. Left and right reinforcing ribs 64*a*,64*b* made from angle iron are welded to the underneath of the steel plate. Each reinforcing rib 64*a*,64*b* has a central circular aperture 65 having a diameter of just over one-half an inch, and a circular aperture 66 disposed adjacent each end of the reinforcing rib 64*a*,64*b* and having a diameter of just over one-quarter inch.

Figure 7:
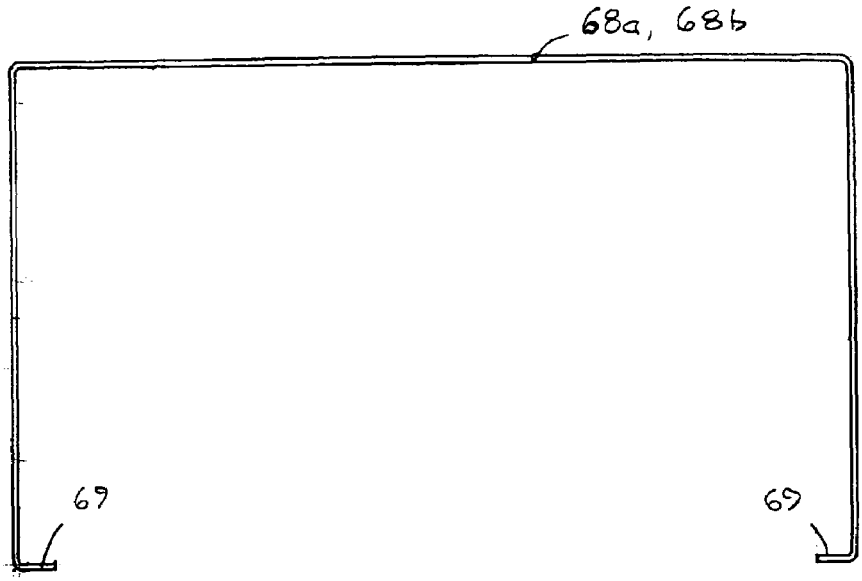
FIG. 7 is an enlarged view of a portion of the frame assembly as shown in FIG. 6, specifically a raised bracket.
Figure 10:
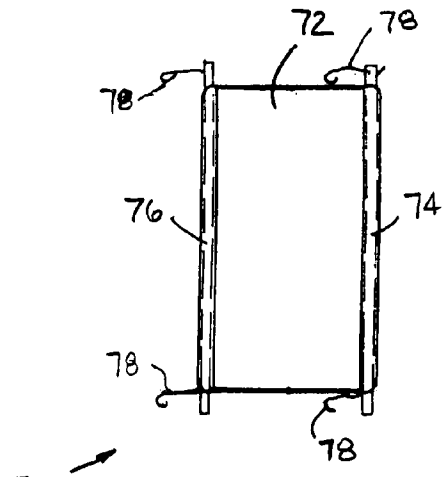
FIG. 10 is an end elevational view of the mixing bag of FIG. 8.
Figure 11:
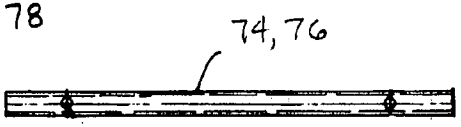
FIG. 11 is a side elevational view of a typical support pipe used in the mixing bag of FIG. 8.
Figure 8:
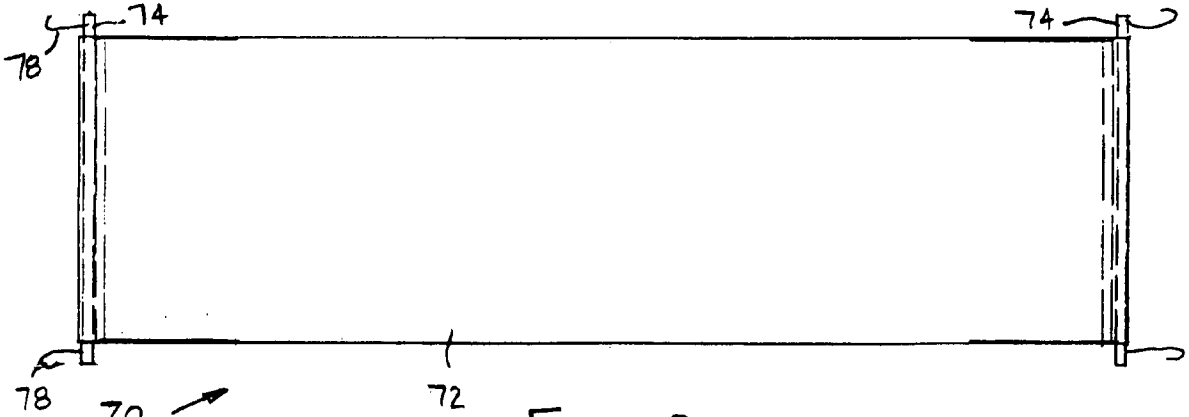
FIG. 8 is a top plan view of the mixing bag of the portable mixer of FIG. 1.
Figure 9:
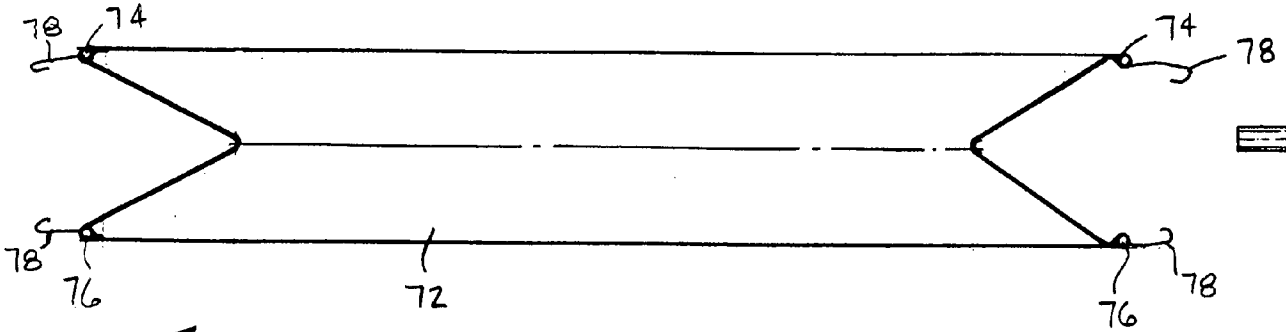
FIG. 9 is a side elevational view of the mixing bag of FIG. 8.

The deck assembly 60 also includes fore and aft raised brackets 68*a*,68*b* each made from one-quarter inch diameter galvanized steel rod, as can be best seen in FIG. 7, bent in the form of an inverted "U"-shape with one inch transverse tabs 69 at each end. The transverse tabs 69 are inserted into the quarter inch apertures 66 at each end of the reinforcing rib 64*a*,64*b* so as to mount the raised brackets 68*a*,68*b* onto the reinforcing ribs 64*a*,64*b* in overlying relation to the deck member 62.

The deck assembly 60 is pivotally mounted onto the wheel axle 50 such that it can freely tilt forwardly or rearwardly, independently of the tilting of the frame assembly 30.

The mixing bag 70, as can be best seen in FIGS. 8 through 11, is preferably made from a reinforced polyester material and, as shown, comprises a reinforced scrim poly bag 72 having dimensions of about 68 inches in length and about 19 inches in width. Four horizontal support bars are secured to the mixing bag 70. There is a lower support bar 76 disposed at each end of the mixing bag 70 such that the lower support bar 76 is adjacent to the edge of the mixing bag 70. There is also an upper support bar 74 disposed above each lower support bar 76. The mixing bag 70 is attached to each end of the upper support bars 74 only, and not attached along the lengths of the upper support bars 74, with each upper support bar 74 therefore spanning across the mixing bag 70 in open spaced relation above the respective lower support bar 76.

Each of the upper and lower support bars 74,76 has two hooks 78 mounted thereon, one hook 78 adjacent each end of the support bar 74,76. The hooks 78 on the upper support bars 74 hook onto the lower cross-members 44,46 so as to suspend the mixing bag 70 therefrom. The hooks 78 on the lower support bars 76 hook onto the upper support bars 74 so as to suspend the ends of the mixing bag 70 therefrom. The mixing bag 70 is thereby suspended from the frame assembly 30.

Reference will now be made to FIG. 1, which shows the portable mixer 20 of the present invention in use. At the back end of the mixing bag 70, the hooks 78 on the lower support bars 76 are removed from engagement with the upper support bars 74, so as to lower the back end of the mixing bag 70 for access purposes. An amount of concrete mixture is shovelled into the mixing bag 70 and an corresponding appropriate amount of water is poured into the concrete mixture. The concrete mixture and the water are contained within the mixing bag 70 and, as shown in FIG. 1, are disposed adjacent one end of the mixing bag 70, due to the rearward tilting of the portable mixer 20. Once the desired concrete mixture and water have been added into the mixing bag 70, the hooks 78 on the lower support bars 76 are then engaged onto the upper support bars 74.

The material within the mixing bag 70 is mixed by alternatingly lifting upwardly and pushing downwardly on the handles 39 at the back end of the longitudinal frame member 34. When the handles 39 are lifted upwardly, the frame tilts forwardly about the wheel axle 50 and the material within the mixing bag 70 shifts forwardly towards the front of the mixing bag 70. The wheels 54 essentially act as a fulcrum. The movement of the material causes the deck assembly 60 to tilt downward at the front. Subsequently, the handles 39 are pushed downwardly, thus tilting the back end of the frame assembly 30 downwardly around the wheel axle 50, so as to cause the material within the mixing bag 70 to shift rearwardly towards the back end of the mixing bag 70. When the handles 39 are pushed downwardly, the frame tilts rearwardly about the wheel axle 50 and the material within the mixing bag 70 shifts rearwardly towards the back of the mixing bag 70. The movement of the material causes the deck assembly 60 to tilt downward at the back. During the mixing process as described above, the raised brackets 68*a*,68*b* limit the upward motion of the mixing bag 70, so as to prevent the material therein from being catapulted out the front or rear of the portable mixer 20. In this above described manner, the material in the mixing bag 70 is thoroughly mixed as the portable mixer 20 is rocked fore and aft.

Once the mixing process has been completed, the hooks 78 attached to the rear lower support bar 76 and hooked onto the rear upper support bar 74, are removed from engagement with the rear upper support bar 74. The thoroughly mixed cement contained by the mixing bag 70 may be readily poured out once the rear lower support bar 76 is lowered to the ground.

The above in-use description is made with reference to mixing cement. The portable mixer 20 of the present invention can analogously be used to mix other materials such as compost.

The portable mixer offers the following advantages over the prior art:

The poly scrim bag provides for the containment of concrete or composite materials for mixing without shoveling or cleaning after use.

The wheels provide for a movable cart and a pivot point to overlapping materials for mixing inside of the bag.

The steel plate provides tilting motion to overlapping materials for mixing materials inside of the bag when pushing up and down on the handles at the end of the frame.

The radical bottom frame gives maximum tilting motion to mix materials rapidly.

The poly scrim bag provides for easy shoveling in of the materials and for pouring the mixed materials out without cleaning after use.

The poly scrim bag is inexpensive and can be changed easily.

The galvanized pipe frame is easily assembled and disassembled for reuse or storage.

The portable mixer can also be used as a cart for transporting materials, such as earth, sand, gravel, fruits and vegetable without spilling materials.

The portable mixer can be used for a movable composter for home.

There is no need to shovel during mixing. Just shovel the material into the scrim bag and pour it out afterwards.

Any loose material can be easily mixed together by just pushing down and up the end of the frame.

Multiple bags can be used one at a time. The bags can subsequently be transported with the mixed material therein.

Transparent bags can permit viewing of the mixing process, which is especially helpful for the mixing of compost.

The poly scrim bag are easy to clean because they are plastic.

As can be understood from the above description and from the accompanying drawings, the present invention provides a portable mixer that mixes concrete, wherein it is not necessary to lift the bag of concrete mixture two or three feet in order to dump the concrete mixture into the mixer, wherein the mixer is easy to clean, wherein a shovel is not required to mix the water into the concrete mixture, wherein the mixing of the concrete is not physically demanding, and provide a portable mixer that mixes compost, wherein the proper mixing of the compost is not overly time consuming, wherein the proper mixing of the compost is not difficult even if the composter is relatively full, wherein all of the compost in the container is mixed fully and properly, all of which features are unknown in the prior art.

Other variations of the above principles will be apparent to those who are knowledgeable in the field of the invention, and such variations are considered to be within the scope of the present invention. For instance, the bags could be closable to permit at least brief transportation of mixed concrete. Further, other modifications and alterations may be used in the implementation of the present invention without departing from the spirit and scope of the invention.

I claim:

1. A portable mixer comprising:

a frame assembly;

at least one wheel rotatably mounted on said frame assembly;

a deck assembly pivotably mounted on said frame assembly for tilting forwardly and rearwardly; and a mixing bag suspended from said from assembly;

wherein a left half and a right half of said frame assembly are substantially mirror images of each other;

and wherein each of said left half and right half of said frame assembly comprises a "U"-shaped frame member and a straight longitudinal frame member spanning across the top of the "U"-shaped frame member.

2. The portable mixer of claim 1, wherein said frame assembly further comprises two upper cross-members that connect together the left and right halves of the frame assembly.

3. The portable mixer of claim 2, wherein said frame assembly further comprises two lower cross-members that connect together the left and right halves of the frame assembly.

4. The portable mixer of claim 3, wherein said hooks connected to said upper support bars are hooked onto said lower cross-members.

5. The portable mixer of claim 4, wherein said hooks connected to said lower support bars are hooked onto said upper support bars.

* * * * *